United States Patent [19]

Anderson

[11] 3,932,280

[45] Jan. 13, 1976

[54] CLOSED WATER SYSTEM IN MUNICIPAL INCINERATION PLANTS

[75] Inventor: Grant L. Anderson, Ogden, Utah

[73] Assignee: Clear Air, Inc., Ogden, Utah

[22] Filed: Mar. 29, 1974

[21] Appl. No.: 456,227

[52] U.S. Cl. ..... 210/119; 110/8 R; 210/152; 210/260; 210/526

[51] Int. Cl.[2] ..... B01D 21/24

[58] Field of Search ..... 210/104, 152, 196, 295, 210/526, 260; 55/101; 110/8 R, 119, 165 R

[56] References Cited

UNITED STATES PATENTS

| | | | |
|---|---|---|---|
| 1,294,551 | 2/1919 | Smethurst | 210/104 |
| 3,031,981 | 5/1962 | Smguder | 110/8 R |
| 3,064,816 | 11/1962 | Griswold | 210/104 |
| 3,435,593 | 4/1969 | Nordone | 55/101 |
| 3,623,975 | 11/1971 | Cardinal, Jr. | 110/8 R |
| 3,734,036 | 5/1973 | Abos | 110/8 R |
| 3,794,565 | 2/1974 | Bielski et al. | 110/119 |
| 3,841,240 | 10/1974 | Wentworth et al. | 110/8 R |

*Primary Examiner*—Theodore A. Granger

[57] ABSTRACT

A municipal incinerator plant incorporating a closed water system comprising a quencher tank and a clarifier tank. Waters from the quenching tank and clarifier tank are intermixed for alkaline-acidic neutralization, and waters from the clarifier tank are fed to a scrubber for supplying initial cleaning action to particulates entrained in incinerator exhaust. Clarifier tank likewise collects electrostatic precipitator fly ash. Quencher incinerated materials, particulates and fly ash are mutually combined for delivery to a dump vehicle or other conveyance means.

6 Claims, 1 Drawing Figure

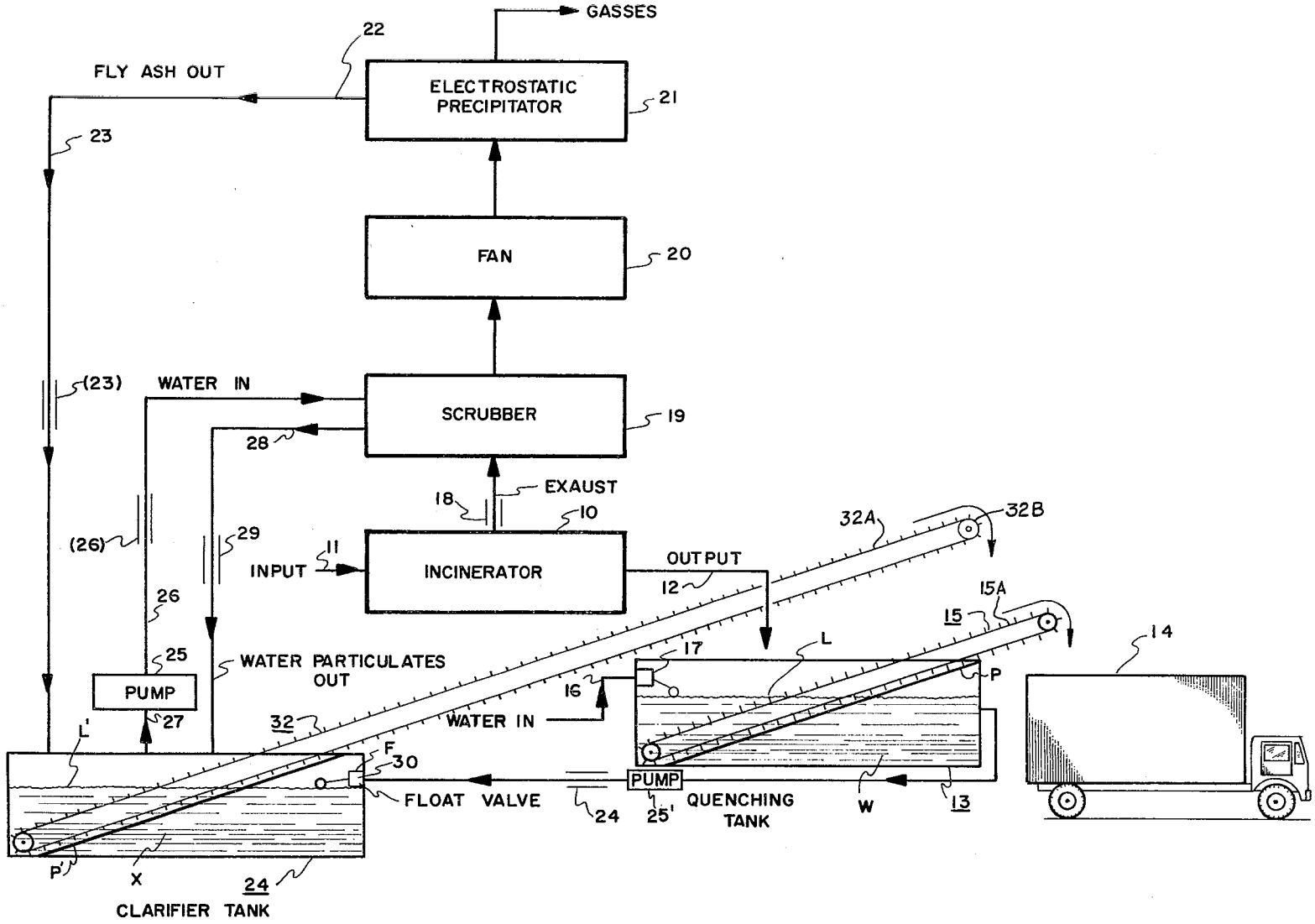
GASSES
ELECTROSTATIC PRECIPITATOR
FAN
SCRUBBER
EXAUST
INCINERATOR
OUTPUT
INPUT
WATER IN
WATER PARTICULATES OUT
FLY ASH OUT
PUMP
QUENCHING TANK
WATER IN
FLOAT VALVE
CLARIFIER TANK
21
20
19
10
11
12
13
14
15
15A
16
17
18
22
23
(23)
(26)
24
25
25'
26
27
28
29
30
32
32A
32B
L
L'
P
P'
W
X
F

CLOSED WATER SYSTEM IN MUNICIPAL INCINERATION PLANTS

The present invention relates to municipal incineration plants, and more particularly, to a new and improved plant wherein the creation of ponds, the necessity of sumps, and the discharge of non-neutral waters into sewage systems of other lines are avoided. Specifically, this present invention supplies a closed water system for both quenching and clarifying, with the waters of both being combined for neutralization purposes and general avoidance being taken as to introduction of output into external sewage lines and so forth.

In the present invention an incinerator is employed wherein the exhaust is fed through a serially connected scrubber, fan and electrostatic percipitator means. A clarifier tank is provided, with waters thereof being fed to the scrubber and water and particulates from the scrubber descending back to the clarifier tank. Fly ash from the electrostatic precipitator means is likewise fed back to the clarifier tank, and conveyance means is provided for collecting fly ash settlings from the clarifier tank and transporting the same to a quenching tank conveyor provided the system. Either and preferably both of the quenching tank and clarifier tank are float-valve operated. Incineration products of the incinerator, including non-incinerated materials such as glass, dirt, metals and so forth, are collected for deposit into a dump vehicle or for other processing.

Accordingly, a principal object of the present invention is to provide a new and improved municipal incineration system.

A further object is to provide an essentially closed water system in municipal incineration plants.

A further object is to provide incineration system which completely eliminates water pollution problems.

An additional object is to provide in an incineration system a quenching tank for incinerated materials as well as a clarifier tank cooperable with scrubber means for the incinerator.

A further object is to provide quenching tank and clarifier tank means for incineration system, and this in a manner such that there may be an intermixing of waters, as by an introduction of water from the quenching tank into the clarifier tank, and this so that there may be effected a neutralization of waters at the clarifier tank means.

A further object is to collect scrubber and electrostatic precipitator particulates into a single clarifier tank stage such that the latter may be combined and conveyed, proximate the residue area of the quenching tank of the incinerator plant, and this for subsequent conveyance to transport vehicles or for further processing.

The features of the present invention may best be understood by reference to the following description taken in connection with the accompanying drawing in which:

The sole FIGURE is a schematic view of the plant and system of the present invention incorporating both quenching tank and clarifier tank as well as means for their intercooperation.

In the drawing, incinerator 10 may take any form but preferably includes, as a means for supplying a continuing throughput, a grate structure similar to that described in a co-pending United States patent application entitled GRATE STRUCTURE FOR INCINERATION PLANTS, Ser. No. 461,956 filed Apr. 18, 1974, now U.S. Pat. No. 3,882,803 by the present inventor as a co-inventor. In any event, the incinerator should have some means of supplying a continuous throughput as by an endless conveyor, moving grates, and so forth. Incinerator 10 has an input 11 and also an output at 12 the latter which falls into quenching tank 13. Thus, the firing of the incinerator will produce combustion as to combustable products in the incinerator. Remaining materials such as rock, dirt, glass and so forth will simply be discarded with the ash and any other remainder, from the incinerator into quenching tank 13.

The purpose for the quenching tank of course is to reduce the temperature of the material prior to the conveyance of solids therefrom to an awaiting dump truck vehicle 14, for example. Quenching tank 13 will include a conveyor 15 so mounted and cooperating with the interior of the quenching tank such that a major portion, if not all, of the materials dumped into the quenching tank will be easily picked up by the conveyor 15 for deposit into dump truck 14.

Quenching tank 13 will include a water inlet at 16, the same preferably being provided with a float valve at 17, this so that water comes into the quenching tank only when the lever L of the water W falls below a certain level.

Serially connected together above the exhaust 18 of incinerator 10 are, respectively, scrubber 19, fan 20, and electrostatic precipitator 21. Precipitator 21 includes a fly ash output 22 and appropriate conduit or other means at 23 whereby the fly ash will be conducted into a clarifier tank 24. Conduit 24 includes pump 25' and is connected between clarifier tank 24 and quenching tank 15 such that water from the latter may proceed into the former once the float valve F, disposed within the clarifier tank, senses that liquid therewithin at X falls below a predetermined level at L' . Pump 25 includes conduit 26 and 27, simply shown by the arrow lines, which connect the clarifier tank 24 to scrubber 19. Thus, water is pumped from the clarifier tank via pump 25 into the scrubber to supply pressured water spray within the scrubber for performing the scrubber action. Discharge water from the scrubber is taken at 28 and is discharged downwardly via conduit 29. The latter discharge includes water plus scrubber-removed particulates.

The combination of incinerator, scrubber, fan and electrostatic precipitator, standing alone, is conventional and well known in the art. Thus, particulates coming up the exhaust flue at 18 proceed through the scrubber for water-washing; the fan draws remaining particulates into the electrostatic precipitator from which gases are exhausted. Drawn from the gases will be fly ash that drop onto or simply proceed otherwise into clarifier tank 24.

An important feature of the invention is in the provision of both clarifier tank and quenching tank, each having a perforate or solid partition or conveyor floor P and P', and also the combination of the two tanks wherein water from the quenching tank proceeds into the clarifier tank.

It has been observed that a clarifier tank receiving fly ash from an electrostatic precipitator as well as scrubber particulates from scrubber 19 will be on the acid side relative to pH. Correspondingly, the condition of the waters within quenching tank 13, receiving the output of burned materials will be alkaline.

Conventional disposing techniques simply discharge these materials into ponds or out-drain lines in the sewer systems. As to alkaline components, there is somewhat less of a problem than the acidity from fluids within the clarifier tank. In the present invention, discharge into sewage systems can be avoided and an actual neutralization of waters used effected, this by conveying waters from the quenching tank at 24 to proceed into the clarifier tank such that waters within the clarifier tank remain essentially neutral at a value of pH 7.

Thus, clean water comes in at 16. The system comprising the quenching and clarifier tank is essentially closed. Clean water at 16 being used merely to compensate for effects of the operation. Thus, and in operation, when the float valve at 17 senses a lowered condition as to water level L, then the float valve 17 opens such that water at 16 proceeds into the quenching tank 13. In turn, when the level of the fluid at L′ and clarifier tank 24 falls below predetermined level, then the float valve at F lowers in a conventional manner so as to open inlet 30 and thereby prevent waters from the quenching tank to proceed into the clarifier tank.

It is noted that the clarifier tank supplies water to the scrubber. A conveyor at 32 is disposed at the bottom of the clarifier tank and includes an upper flight 32A proceeding upwardly and outwardly therefrom such that output may fall over end 32B and be deposited onto the quenching tank conveyor 15 at the upper flight 15A thereof. Thus, fly ash from the clarifier tank and residue from quenching tank are combined at conveyor 15 for subsequent delivery to awaiting dump vehicle 14.

It is thus seen that the present invention supplies for incineration systems a closed water system for providing water to the scrubber portion of the system. Residues from the quenching tank and clarifier tank of the systems are combined for a single waste products output for dump or loading of a conventional dump vehicle. The alkaline condition of the quenching tank is utilized to neutralize the acidic condition of the clarifier tank to direct flow of quenching tank waters into the clarifier tank. Additionally, sumps, pools, drains and introduction of off-neutral fluids into sewage lines are avoided.

Owing to particulate sizes, it is imminently preferable that water flow from the quenching tank to the clarifier tank in fact be as shown by the arrow proximate conduit 24. However it is conceivable that water flow could be reversed, with inlet water being introduced directly into the clarifier tank 24.

While particular embodiments of the invention have been shown and described, it will be obvious to those skilled in the art the various changes and modifications which may be made without departing from the essential features of the present invention and, therefore, the aim in the appended claims is to cover all such changes and modifications as fall within the true spirit and scope of the invention.

I claim:

1. In the combination of an incinerator having a gases' exhaust means, a materials' input, and an incinerated materials' output, and a scrubber coupled to said exhaust means: an improvement comprising quenching tank means for receiving said output, clarifier tank means for introducing water into and receiving water and particulates from said scrubber, means for introducing water into said quenching tank means, first and second endless-belt conveyor structure means having lower ends disposed in said clarifier tank means and quenching tank means, respectively, for respectively conveying solely solids from said clarifier and quenching tank means, said first and second endless-belt conveyor structure means each including an upper flight terminating in an upper end, said upper flight of said first endless-belt conveyor structure means being constructed and arranged for discharge over said upper end thereof upon said upper flight of said second endless-belt conveyor structure means, and means for conducting water solely one way from said quenching tank means into said clarifier tank means.

2. The structure of claim 1 wherein said upper end of said first endless-belt conveyor structure means is disposed above said second endless-belt conveyor structure means and beyond said quenching tank means, said second endless-belt conveyor structure means extending beyond said quenching tank means.

3. The structure of claim 2 wherein each of said tank means include respective float valve means for regulating respective water-flow into the respective tanks and accordance with tank fluid level.

4. The structure of claim 1 wherein in said combination there is provided fan means for receiving and drawing exhaust from said scrubber and electrostatic precipitator means coupled to said fan means, and conduit means for conveying fly ash from said electrostatic precipitator means to said clarifier tank means.

5. Structure according to claim 1 wherein said quenching tank means comprises a quenching tank, and one-way pump means for pumping water solely from said quenching tank to said clarifier tank means.

6. Structure according to claim 1 wherein said clarifier tank means comprises a clarifier tank and also pump means operatively associated with said clarifier tank for pumping water solely therefrom to said scrubber.

* * * * *